United States Patent [19]

Rear

[11] 4,013,325

[45] Mar. 22, 1977

[54] DRILL ROD STABILIZING TOOL

[76] Inventor: Ian Graeme Rear, 53 Louise St., Nedlands, Perth, Australia, 6000

[22] Filed: Sept. 4, 1975

[21] Appl. No.: 610,219

[30] Foreign Application Priority Data

Sept. 4, 1974 Australia ..... 8759/74

[52] U.S. Cl. ..... 308/4 A; 175/325

[51] Int. Cl.[2] ..... F16C 1/26

[58] Field of Search ..... 308/8.2, 4 R, 4 A; 175/325, 53, 363, 364, 371, 372, 410

[56] References Cited

UNITED STATES PATENTS

| | | | |
|---|---|---|---|
| 2,742,264 | 4/1956 | Snyder | 175/325 X |
| 3,659,663 | 5/1972 | Dysart | 175/325 |
| 3,818,999 | 6/1974 | Garrett | 175/325 |
| 3,907,048 | 9/1975 | Gray | 175/325 |

*Primary Examiner*—Joseph F. Peters
*Assistant Examiner*—Gene A. Church
*Attorney, Agent, or Firm*—William Anthony Drucker

[57] ABSTRACT

A stabilizing tool comprising a substantially cylindrical body; said body having a plurality of substantially cylindrical chambers formed therein said chambers being located axially within the body and spaced symmetrically around the body with respect to the longitudinal central axis thereof, wherein the diameter of the chambers is such that a portion of the wall would extend beyond the perimeter of the body to provide axial rectangular openings in the side of the body; each end of the body being provided with an axial fluid passageway which is divided to provide a fluid path through each chamber; stabilizing rollers rotatably mounted upon a hollow shaft mounted in said chambers such that the circumference of rotation of the rollers extend through said rectangular openings beyond the body; a lubricant reservoir provided in said body and vented to the fluid passageway for the application of fluid pressure to the lubricant in the reservoir; and outlets in the reservoir communicating with the bearing surfaces between the rollers and shafts.

13 Claims, 4 Drawing Figures

DRILL ROD STABILIZING TOOL

This invention relates to a stabilizing tool used in rock drilling and the like.

Stabilizing tools are mounted in a drill stem for maintaining the orientation of the drill stem in the bore hole during drilling operations. Such tools are generally used with fluid operated or driven drills. The fluid for the drill bit passing axially through the stabiliser and upon being exhausted from the bit to the bore hole escape upwards in the bore hole carrying the drill cuttings from the bit.

Stabilizing tools currently in use have very short working lives due to excessive wear as a result of the cuttings being carried up through the bore hole and wear upon the bearing surfaces for the stabilizing rollers.

It is an object to increase the stabilizer working life but also provide a stabilizer which is economical in manufacture and requires little servicing.

In one form the invention resides in a stabilizing tool comprising a substantially cyclindrical body; said body having a plurality of substantially cylindrical chambers formed therein, said chambers being located axially within the body and spaced symmetrically around the body with respect to the longitudinal central axis thereof, wherein the diameter of the chambers is such that a portion of the wall would extend beyond the perimeter of the body to provide axial rectangular openings in the side wall of the body; each end of the body being provided with an axial fluid passageway which is directed to provide a fluid path through each chamber; for the flow of drilling fluid through the stabilizing tool stabilizing rollers rotatably mounted upon a hollow shaft mounted in said chambers such that the circumference of rotation of the rollers extend through said rectangular openings beyond the body; a lubricant reservoir to store a lubricant different from the drilling fluid provided in said body and vented to the fluid passageway for the application of fluid pressure to the lubricant in the reservoir; and out lets in the reservoir communicating with the bearing surfaces between the rollers and shafts.

The invention will be more fully understood in the light of the following description of one specific embodiment. The description is made with reference to the accompanying drawings of which:

Figure 1:
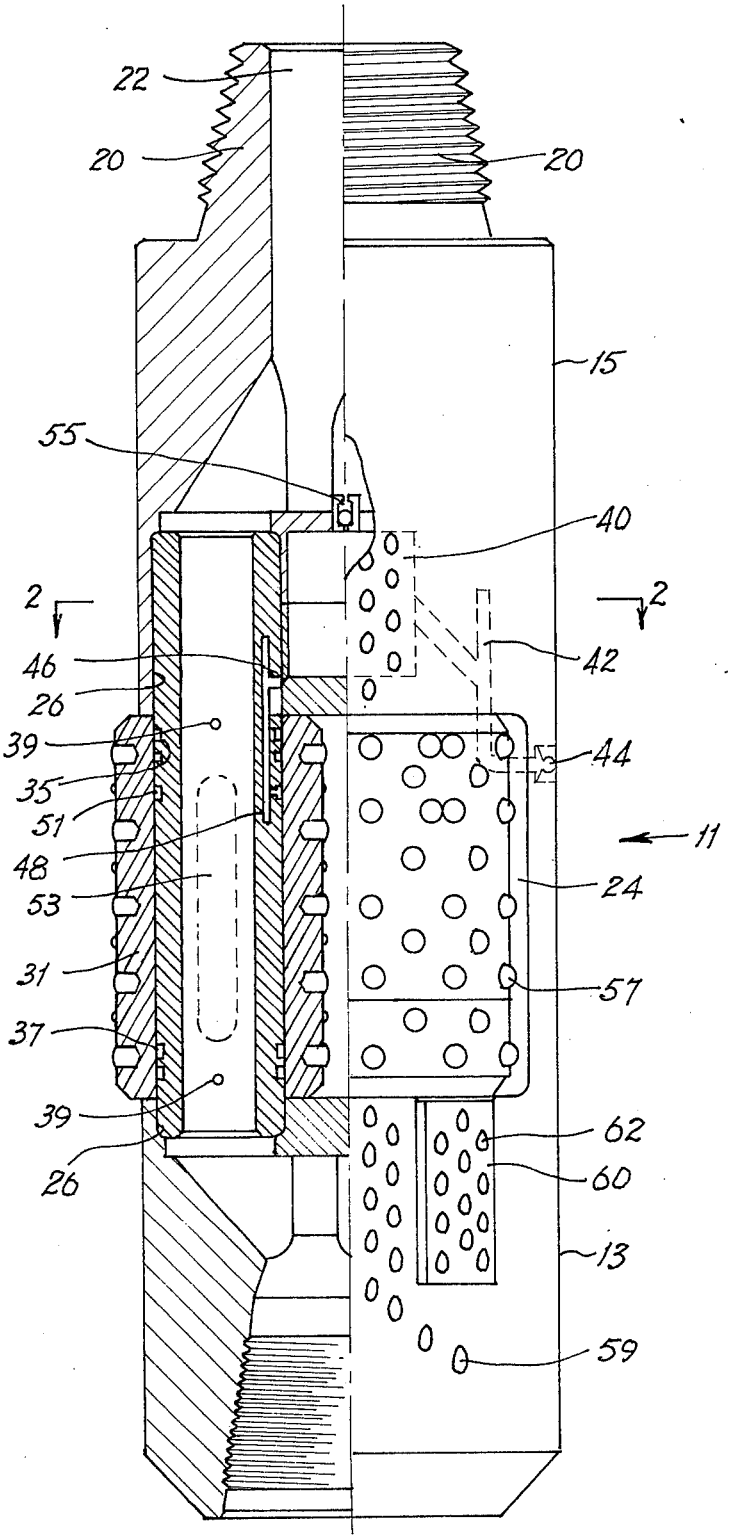
FIG. 1 is a part sectional view of a stabiliser according to the embodiment.
Figure 2:
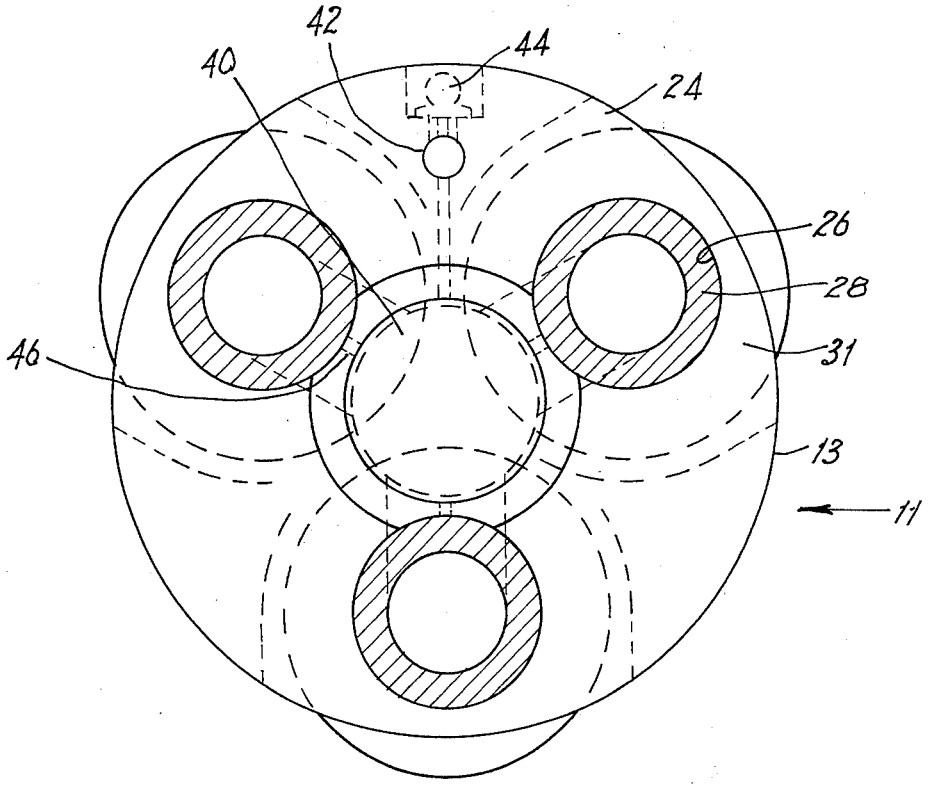
FIG. 2 is a sectional view along line 2—2 of FIG. 1.

The embodiment shown in the drawings is directed to a roller stabilizer to be mounted in a drill stem during rock drilling operations to prevent drill stem wear, drill stem wobble, hole deviation and maintain drill bit life. The body of the stabilizer body 11 is formed in two portions, a main portion 13 which houses the components of the stabilizer and a crown portion 15 which is intended to enclose the upper surface of the main portion. The portions 13 and 15 are only separate during assembly of the tool to facilitate ready assembly and after assembly the two portions are welded together. To facilitate welding of the main portion 13 and crown portion 15 the adjacent edges are bevelled as may be seen at 17 in FIG. 1.

The lower end of the stabilizer is provided with a central axial passageway 19, threaded and suitably adapted for attachment of a drill thereto. The upper end is provided with a threaded spigot 20 for attachment to the end of the drill stem. There is provided in the upper end of the body 11 and through the spigot 20 a central axial passageway 22. The two end axial passageways open directly into three substantially cylindrical chambers symmetrically placed in the body with respect to the central longitudinal axis of the body, such that their longitudinal central axis is parallel to the central longitudinal axis of the body. The dimensions of each chamber are such that a portion of their cylindrical volume would extend beyond the perimeter of the body to form a rectangular aperture 24 in the walls of the body.

The upper and lower end face of each chamber are further provided with central cylindrical sockets 26 for receiving the ends of the hollow shaft 28. Each shaft rotatably supports a stabilizing roller 31 which are accommodated within the chambers formed in the body. The diameter of each roller is such that upon rotation of the stabiliser the circular path traced by the outermost point of the rollers is greater than that of the body.

Figure 3:
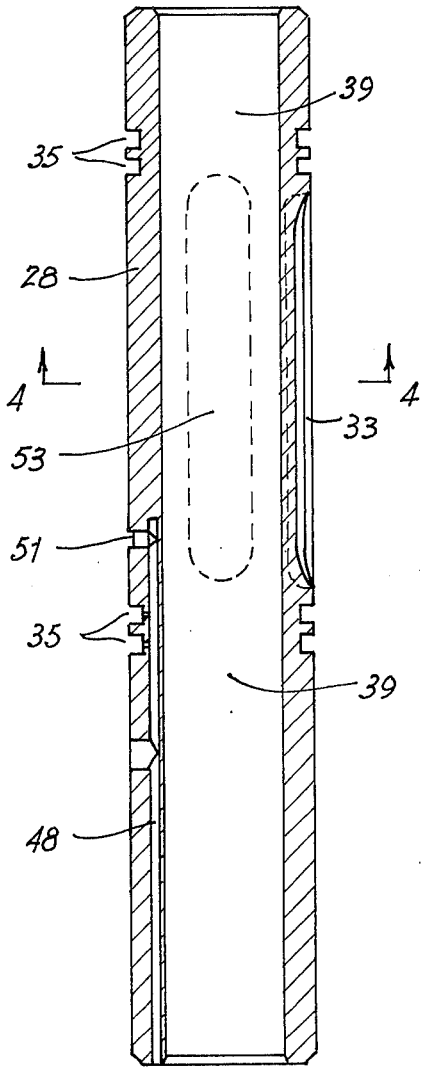
FIG. 3 is a longitudinal sectional view of a roller supporting shaft of the stabiliser of FIGS. 1 and 2.
Figure 4:
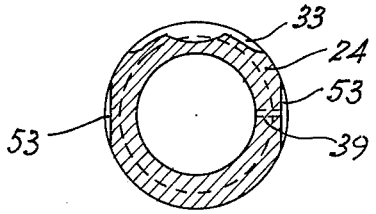
FIG. 4 is a sectional view along line 4—4 of FIG. 3.

The shafts 28 for supporting the rollers 31 are hollow and are in communication with the axial passageways 19 and 22 at either end of the body. As a result of such there is little restriction to flow of fluid through the stabilizer on its path to the drill bit. In addition the flow of the fluid through the shaft facilitates the cooling of the stabilizer in operation at the location of greatest loading thereon. In addition as may be observed in FIGS. 3 and 4 each shaft is formed with a wear resistant portion 33 formed on one side of the shaft and extending longitudinally thereon. In mounting the shaft 28 into the body the high wearing portion 33 is located such that it faces radially outwards as this is the portion of the shaft experiencing the greatest loading from the roller 31 during drilling operations.

Towards the upper and lower limits of the roller supporting portion of each shaft 28 there are provided two circumferential grooves 35 for the receipt of seals 37 between the roller 31 and shaft 28. The seals 37 are formed of a suitable metal which is capable of withstanding high temperatures and considerable wear. The seals 37 are in the form of an incomplete circular ring. Upon mounting the rollers 31 upon the shaft 28 the sealing members are compressed to permit the rollers to slide over them. Once the roller is mounted upon the shaft there is a fluid tight seal formed between the shaft 28 and roller 31 at either end of the roller.

Two small apertures 39 are formed in the shaft towards each end of the shaft to provide fluid communication from the interior of the shaft 28 to the space between the shaft 28 and roller 31 above and below the upper and lower seals 37 respectively. The purpose of the bleed holes 39 is to prevent the collection of foreign matter in the region of the seals 37 and so prolong the life of the seals 37.

At the lower termination of the axial passage 22 at the upper end of the body 11 there is formed a reservoir 40 for the storage of a suitable lubricant. The reservoir 40 is formed by the engagement of the adjacent faces of the main portion 13 and crown portion 15 of the body 11. A channel 42 formed by appropriate drilling procedures interconnects the reservoir with a nipple 44 mounted at the external termination of the channel 42. Outlet channels 46 from the reservoir 40 and through the body 11 mate up with a channel 48 provided in each shaft 28 which have their outlet at the bearing surfaces between the shaft 28 and roller 31 and between the sealing members 37. The outlet of the channel 46 communicates with a circumferential groove 51 in the shaft which also communicates with a flattened portion 53 of the shaft. The purpose of the groove 51 and flat portion 53 is to provide for the transport of lubricant over the complete bearing surface. The reservoir 40 is in communication with the end axial passageway 22 through a check valve 55 which is intended to prevent any back flow of lubricant into the fluid passageway. However it is preferable that the check valve 55 permits the release of the fluid pressure in the reservoir when the flow of fluid through the stabiliser ceases.

It is preferable that the lubricant used be of a low and constant viscosity type.

In operation the fluid flowing through the fluid passageways in the stabilizer exerts a pressure upon the lubricant in the reservoir 40. As a result of the fluid pressure the lubricant is forced from the reservoir 40 through the outlet channels 46 and 48 to the bearing surfaces of the shafts 28 and rollers 31. The sealing members 37 on the shafts prevent loss of grease from the space therebetween and so prevent clogging up of the stabilizer rollers. As a result of the lubrication feed system the supply of lubricant to the bearing surfaces only takes place during actual use since when not in use the fluid pressure is no longer being applied to the reservoir. At the conclusion of each drilling operation the reservoir 40 may be readily refilled through the nipple 44 in readiness for the next drilling operation.

Carbide buttons 57 are preferably provided on the exterior surface of the rollers 31 to prevent wear of the rollers during operation. In addition it is desirable to reduce the wear on the body 11 of the stabilizing tool as a result of the movement of cuttings up the bore hole in order to maintain a high velocity of fluid past the stabilizer in the bore hole. The high velocity fluid flow is caused by a small clearance between the stabilizer and sides of the bore hole and wear of the body will cause a reduction in such velocity to produce a recirculation of cuttings in the region of the drill bit. The greatest amount of wear appears to occur at the upper and lowermost ends of the body. In order to reduce any excessive wear on the body the exterior of the stabilizer body has mounted thereon carbide buttons 59 arranged in at least two diametrically spaced longitudinal rows. In addition the upper and lower ends of the stabilizer may be provided with a circumferential ring of hardened material. A further wear reduction element comprises a wear plate 60 mounted to the body 11 of the stabilizer directly below each roller 31 and provided with carbide buttons 62.

The surface of the wear plate 60 is raised above that of the surface of the body and its effect is to reduce the wear on the leading lower edge of the roller 31.

The stabilizer of the embodiment has a distinct advantage over those currently in use because of its resistance to wear and resultant long life. The resistance to wear is as a result of the hardened portion of the roller support shafts, the lubrication feed system and ready servicing thereof and the preferred use of wear resistant elements on the body and rollers of the stabilizer.

I claim:

1. A stabilizing tool, comprising:

a substantially cylindrical body, said body having a longitudinal axis;

said body having a plurality of substantially cylindrical chambers formed therein said chambers being located axially within the body and spaced symmetrically around the body with respect to the longitudinal central axis thereof, wherein the diameter of the chambers is such that a portion of the wall extends beyond the perimeter of the body to provide axial rectangular openings in the side of the body;

each end of the body being provided with an axial fluid passageway which is divided to provide a fluid path through each chamber for the flow of drilling fluid through the stabilizing tool;

stabilizing rollers rotatably mounted upon a hollow shaft mounted in said chambers such that the circumference of rotation of the rollers extend through said rectangular openings beyond the body;

a lubricant reservoir provided in said body and vented to the fluid passageway for the application of fluid pressure to the lubricant in the reservoir; and outlets in the reservoir communicating with the bearing surfaces between the rollers and shafts, wherein the lubricant reservoir is to store a lubricant of a different form from the drilling fluid.

2. A stabilizing tool as claimed in claim 1 wherein fluid seals are provided on said hollow shafts towards either end of the roller supporting portion thereof to provide a fluid seal between the shaft and roller, the outlets from the reservoir communicating with the space between the seals.

3. A stabilizer as claimed in claim 2 wherein the outlets from said rservoir communicate with a circumferential groove formed in the shaft, said groove communicating with a set of longitudinal flattened surface portions formed on said shaft.

4. A stabilizer as claimed in claim 2 wherein an aperture is provided in the wall of the hollow shaft at a location adjacent said fluid seals and located on the side of each seal nearest the respective end of the roller to cause fluid entry into the space between the shaft and the outer end of the roller.

5. A stabilizer as claimed in claim 4 wherein a fluid channel is provided between the reservoir and the exterior surface of the body, a non-return fluid inlet means being provided at the exterior surface end of the fluid channel.

6. A stabilizer as claimed in claim 5 wherein the outermost radial side of the shaft has incorporated therein an especially wear resistant portion.

7. A stabilizer as claimed in claim 6 wherein there are three stabilising rollers symmetrically spaced from the central longitudinal axis of the stabiliser.

8. A stabilizer as claimed in claim 7 wherein the exterior surface of the rollers have wear resistant elements incorporated therein.

9. A stabilizer as claimed in claim 8 wherein the exterior surface of the body has wear resistant elements incorporated therein.

10. A stabilizer as claimed in claim 9 wherein the upper and lower ends of the body are provided with a circumferential ring of material.

11. A stabilizer as claimed in claim 10 wherein a plurality of plates, having incorporated therein wear resistant elements, are mounted to said body, said plates being spaced circumferentially around the body below the lower end of the stabilizing rollers.

12. A stabilizer as claimed in claim 9 wherein the wear resistant elements are mounted in at least one pair of diametrically opposed rows of elements.

13. A stabilizer as claimed in claim 12 wherein said wear resistant elements comprise carbide buttons.

* * * * *